US007234920B2

(12) United States Patent
Imbourg et al.

(10) Patent No.: US 7,234,920 B2
(45) Date of Patent: Jun. 26, 2007

(54) TURBINE CASING HAVING REFRACTORY HOOKS AND OBTAINED BY A POWDER METALLURGY METHOD

(75) Inventors: Sébastien Imbourg, Yerres (FR); Claude Mons, Savigny le Temple (FR); Philippe Pabion, Vaux le Penil (FR); Jean-luc Soupizon, Vaux le Penil (FR)

(73) Assignee: SNECMA Moteurs, Paris (FR)

( * ) Notice: Subject to any disclaimer, the term of this patent is extended or adjusted under 35 U.S.C. 154(b) by 100 days.

(21) Appl. No.: 11/086,426

(22) Filed: Mar. 23, 2005

(65) Prior Publication Data

US 2005/0244266 A1 Nov. 3, 2005

(30) Foreign Application Priority Data

Apr. 5, 2004 (FR) ..... 04 03537

(51) Int. Cl.
*F01D 9/00* (2006.01)

(52) U.S. Cl. ..... 415/213.1; 419/49; 29/889.2

(58) Field of Classification Search ..... 415/200, 415/213.1, 209.3; 29/889.2; 419/49, 68
See application file for complete search history.

(56) References Cited

U.S. PATENT DOCUMENTS 3,940,268 A 2/1976 Catlin
4,063,939 A * 12/1977 Weaver et al. ..... 419/5
4,097,276 A 6/1978 Six
4,445,259 A 5/1984 Ekbom
4,680,160 A 7/1987 Helmink
5,618,161 A * 4/1997 Papageorgiou et al. ..... 415/190
6,217,279 B1 * 4/2001 Ai et al. ..... 415/110
7,070,387 B2 * 7/2006 Crozet et al. ..... 415/173.1

FOREIGN PATENT DOCUMENTS

| | | |
|---|---|---|
| EP | 0 285 778 A1 | 10/1988 |
| EP | 1 288 444 A1 | 3/2003 |
| FR | 2 619 034 | 2/1989 |
| FR | 2 723 868 | 3/1996 |
| WO | WO 3018962 A1 * | 3/2003 |

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

A turbine stator casing comprising a jacket and fastener hooks for fastening a turbine distributor nozzle, the hooks projecting from the inside face of the jacket, said jacket being made of a first alloy by hot isostatic compression using metal powder, said fastener hooks being made out of a second alloy that is more refractory than the first, and being secured to said jacket by diffusion welding during the hot isostatic compression. The casing also comprises inserts passing through the fastener hooks and through said jacket. These inserts, which are likewise secured to the jacket by diffusion welding, serve during manufacture of the casing to fasten the hooks to a mold portion inside which the jacket is formed. The invention is applicable to the turbines of airplane turbojets.

24 Claims, 2 Drawing Sheets

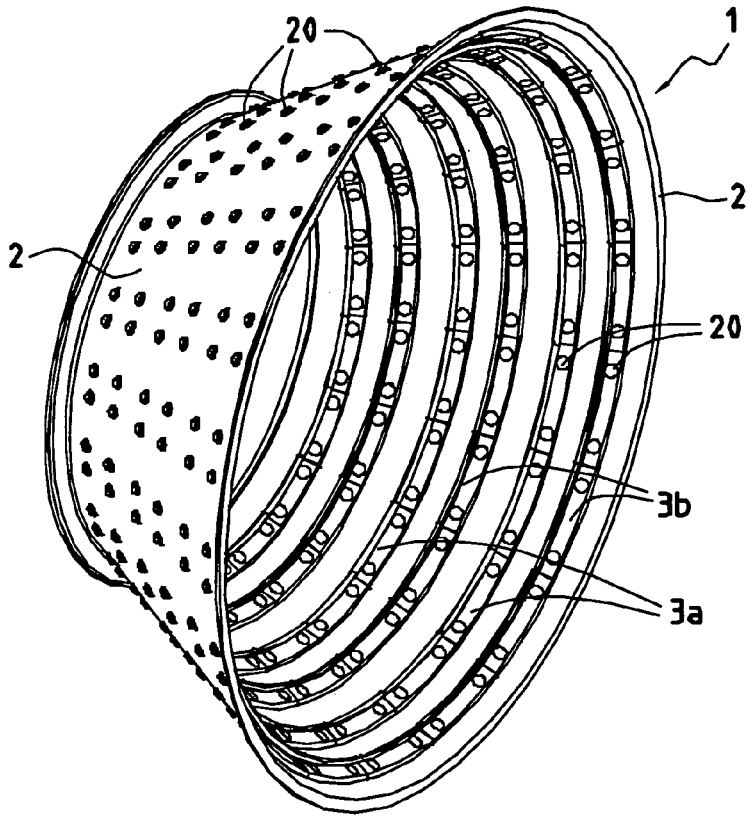
FIG.1
FIG.2
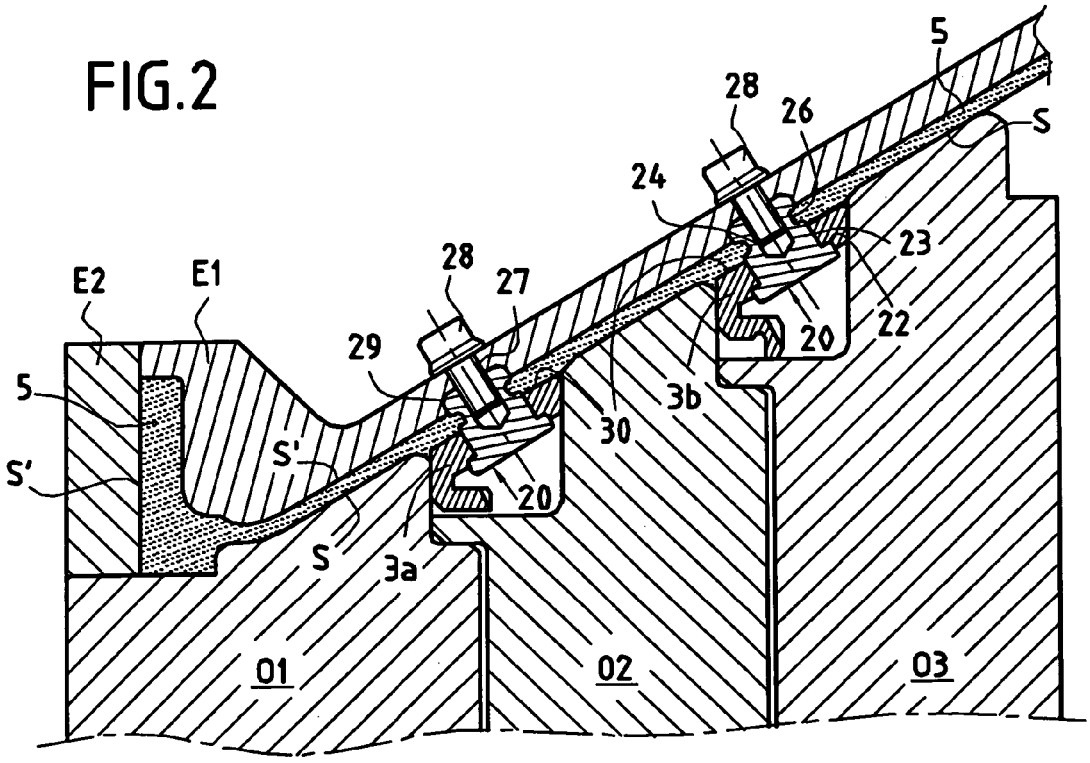

TURBINE CASING HAVING REFRACTORY HOOKS AND OBTAINED BY A POWDER METALLURGY METHOD

The invention relates to a turbine stator casing and to a method of manufacturing it. More particularly, the invention relates to a stator casing for a turbine in an airplane turbojet.

Such a casing comprises a jacket of generally frustoconical shape and fastener hooks secured to said jacket and projecting from its inside face. The fastener hooks are used for supporting rings or ring segments carrying stator blades, which together form an assembly commonly referred to as the distributor nozzle of the turbine. A stator generally comprises a plurality of series of hooks to support a plurality of nozzles, and distributed on the inside face of the jacket. Between these rings, there are located the rotor wheels carrying the moving blades of the turbine rotor. A pair constituted by a nozzle and a rotor wheel constitutes one stage of the turbine.

BACKGROUND OF THE INVENTION

The turbine of an airplane turbojet has combustion gas that is very hot passing therethrough and therefore operates under temperature conditions that are particularly difficult. Thus, the fastener hooks which are in contact with the combustion gas stream are subjected to much greater heating is the jacket which, in any event, is cooled on its outside face by a cooling system, generally a system of perforated pipes, commonly referred to as "shower collars", blowing cool air onto said jacket.

As shown in European patent application EP 1 288 444, it is known to make such fastener hooks out of an alloy that is good at withstanding high temperatures and that might possibly differ depending on the locations of said hooks inside the jacket; it is also known to make the jacket out of a more ordinary alloy, an alloy that is less refractory than that of the hooks, and that is therefore easier and less expensive to form.

In that known embodiment, the hooks are fastened to the jacket by an interference fit, by conventional welding, or by bolting. Those various assembly methods nevertheless present drawbacks.

For example, conventional welding with melting encourages hot cracking in the melt zone and the appearance of cracks in the zone that is thermally affected during welding. Bolting complicates the structure of the casing and increases the number of parts making it up. And none of those assembly means generally presents satisfactory resistance to fatigue.

OBJECTS AND SUMMARY OF THE INVENTION

The invention relates to an improved turbine stator casing in which the jacket is made using a particular method of manufacture, the fastener hooks being secured to said jacket by assembly means of simple structure presenting good mechanical strength and withstanding heating well.

In its most general form, the invention provides a turbine stator casing comprising a jacket and fastener hooks for fastening a turbine distributor nozzle, the hooks projecting from the inside face of the jacket, wherein said jacket is made of a first alloy by hot isostatic compression, using metal powder, said fastener hooks being made of a second alloy that is more refractory than the first, and being secured to said jacket by diffusion welding during the hot isostatic compression.

It should first be observed that the fact of making the casing jacket by hot isostatic compression (referred to herein as HIC) makes it possible to benefit from the advantages of that known manufacturing technique, as described in greater detail below.

Another advantage of the invention lies in the fact that advantage is taken of the cycle for implementing HIC to secure the fastener hooks to the jacket by diffusion welding, thus saving time during manufacture of the casing. The diffusion welding technique is a known technique that enables two parts to be assembled together when they are made of alloys having different compositions but that are nevertheless compatible from the point of view of diffusion.

Thus, in the invention, the hooks are made of a second alloy that is more refractory than the first, such that the hooks can withstand temperatures of not less than 900° C., for example, whereas the jacket can withstand temperatures only up to about 750° C. Naturally, it is possible to use different types of second alloy, that are refractory to a greater or lesser extent, depending on the positions of the hooks inside the jacket and on the temperatures to which they will be subjected. It is known that for certain types of turbojet, the temperature in some stages of the turbine can reach 1050° C. or even 1100° C.

Advantageously, the hooks are made of a casting alloy containing nickel and/or cobalt, and they can be made by an equiaxial monocrystalline casting method or by casting with directed solidification. As a general rule, it can be decided to make the hooks out of alloys analogous to those used for making turbine blades.

The jacket is made out of alloys or super-alloys that are commonly used in aviation, such as the alloy sold under the trademark Waspaloy® or the alloy known under the trademark Inconel 718®. This makes it easy to repair such a jacket, after it has suffered damage, using conventional repair techniques such as welding, assembly, or re-filling. Damage to the jacket may arise, for example, as a result of impact during manufacture or handling.

To sum up, it is advantageous to use first and second alloys that are different since the requirements in use for the jacket and the hooks are different. The hooks must above all present good ability to withstand very high temperatures, whereas the jacket does not need to present such good resistance, but must be capable of being repaired easily. Furthermore, since the hooks withstand high temperatures well, there is no need to cool them with cooling air.

In a particular embodiment of the invention, the casing includes inserts passing through the fastener hooks and said jacket. Advantageously, the inserts are also secured to said jacket by diffusion welding during the hot isostatic compression.

Even if they complicate the structure of the casing slightly, such inserts present several advantages. Firstly they make it possible during manufacture of the casing to secure the hooks to a portion of the mold in which the jacket is formed so as to guarantee that the hooks are properly positioned during the HIC cycle. Thereafter, the inserts can project from the outside face of the jacket so as to form projections. These projections can then be useful for fastening an element on the outside of the casing, for example an element of the cooling system. It is even possible to provide in each insert a tapped bore opening out in the projection and into which it is possible to screw a threaded shank secured to an outside element of the casing.

The invention also provides a method of manufacturing a turbine stator casing comprising a jacket made of a first alloy and fastener hooks for fastening a turbine distributor nozzle, the hooks projecting from the inside face of said jacket, wherein said hooks are made of a second alloy that is more refractory than the first, the hooks are placed inside a mold, the mold is filled with a metal powder of the first alloy, while the hooks are disposed in such a manner as to be in contact with said powder, and said jacket is molded by hot isostatic compression of said metal powder, the hooks being bonded to the jacket by diffusion welding during the hot isostatic compression.

BRIEF DESCRIPTION OF THE DRAWINGS

The advantages of the casing of the invention and of the method of manufacturing the casing will be better understood on reading the following detailed description of a particular embodiment of the invention:

FIG. 1 is a perspective view of an example of a turbine stator casing of the invention;

FIG. 2 is an axial section through a portion of the mold used for molding the jacket of the FIG. 1 casing;

MORE DETAILED DESCRIPTION

Figure 3:
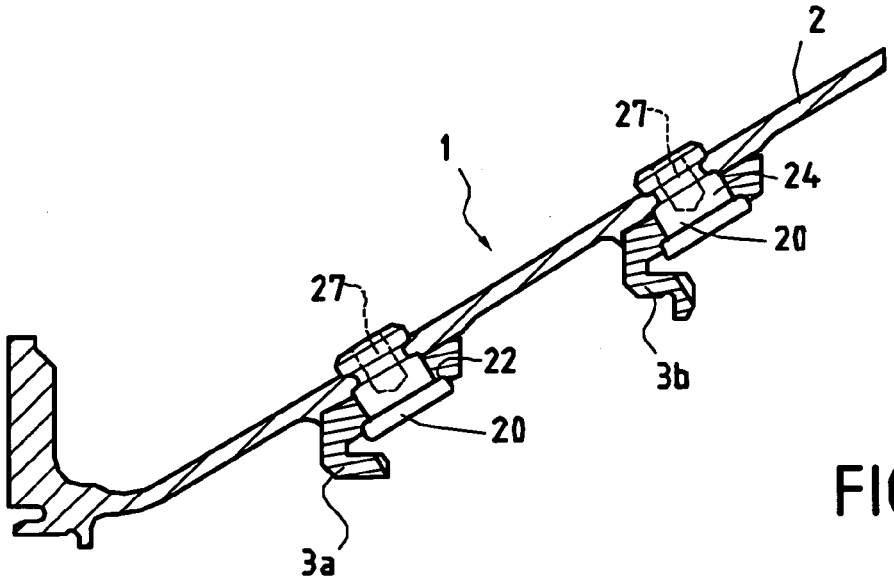
FIG. 3 is an axial section through a portion of the FIG. 1 casing.
Figure 4:
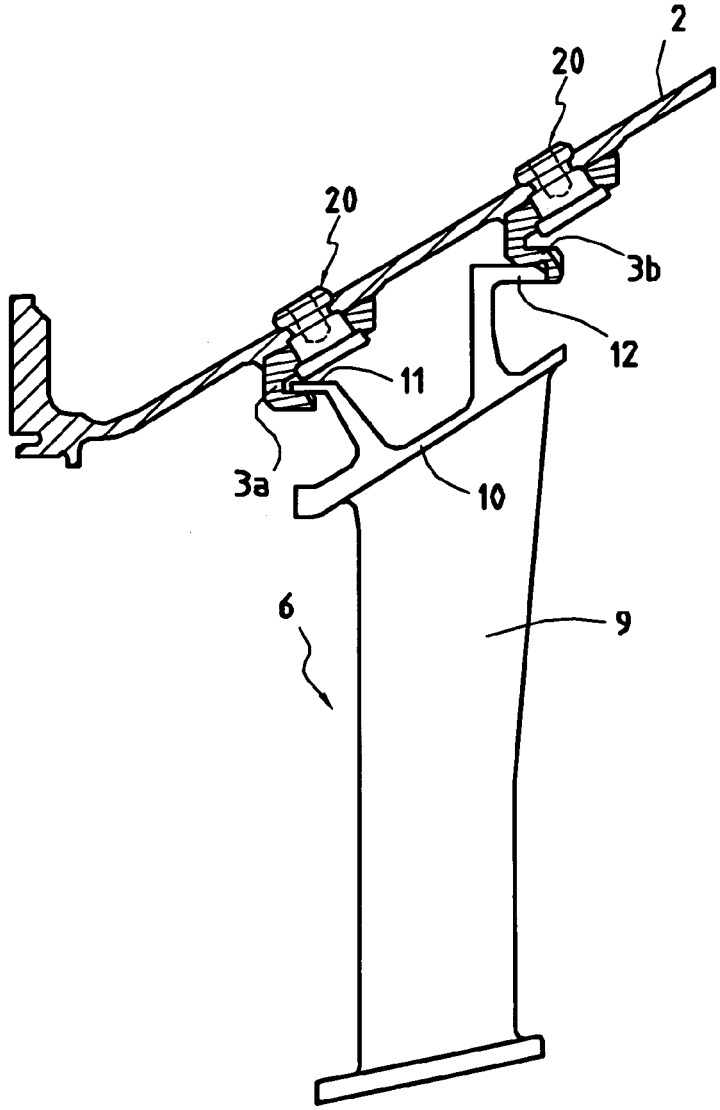
FIG. 4 is an axial section through the portion of the casing shown in FIG. 3, with ring carrying stator blades mounted thereon.

With reference to FIGS. 1, 3, and 4, the example of a casing 1 shown comprises a jacket 2 of generally frusto-conical shape having two types of hook fitted thereto: flat hooks 3*a* and lip hooks 3*b*. Hooks of the same type are in the form of curved segments and they are placed end-to-end so as to form rings of hooks on the inside face of the jacket 2.

In the example shown in FIG. 1, the casing 1 has three rings of flat hooks 3*a* and three rings of lip hooks 3*b*, these rings of different types being interleaved.

As shown in FIG. 4, the hooks 3*a* and 3*b* serve to support a turbine distributor nozzle 6 made up of a ring or of ring segments carrying stator blades 9. These stator blades 9 are connected via their roots to the outer ring 10 of the nozzle 6. The outer ring 10 is provided on its front and rear sides with hooks 11 and 12 suitable for co-operating respectively with the fastener hooks 3*a* and 3*b* of the jacket 2 so that the outer ring 10 is held by the fastener hooks 3*a*, 3*b*.

Now that the structure of the casing 1 is well understood, there follows a description of the method of manufacturing it, given with reference to FIG. 2. This figure shows the tooling used for making the mold into which a metal powder 5 of a first alloy is injected in order to be subjected to hot isostatic compression, i.e. to a particular heating cycle associated with the application of pressure.

In practice, the mold is made up of a plurality of inside tooling parts O1, O2, O3 and of outside tooling parts E1 and E2.

The design of these tooling parts is highly rigorous and makes use of computer-assisted design (CAD) including, in particular, a model of local shrinkage during the HIC of the jacket 2 being formed. This particular technique, known under the name of the method Isoprec® (registered trademark) makes it possible to obtain a casing jacket that is directly of design dimensions, thereby reducing the need for subsequent machining.

As shown in FIG. 2, a substantially cylindrical insert 20 is used for holding the hooks 3*a* or 3*b* in position during HIC. Such an insert 20, which in the example described is circularly symmetrical, comprises a cylindrical body 24 for passing through a circular opening 23 formed in a hook 3*a* or 3*b*, and at a first end a circular shoulder 22 of diameter greater than that of the opening 23 so as to come into abutment against the hook 3*a* or 3*b*. In the example, the diameter of the body 24 is very slightly smaller than that of the opening 23 so that the clearance between the insert and the hook 3*a* or 3*b* is smaller to ensure that the hook does not become disengaged and remains in a stationary position on the insert 20. It is also possible to provide for the insert 20 to be mounted as a forced fit in the opening 23.

The second end of the insert 20, remote from the first, and thus pointing outwards, is suitable for being received in a housing 29 provided for this purpose in the outer tooling E1. A bore passes through this tooling E1 and opens out at one end to its outside surface and at its other end into the housing 29. Another bore 27, this bore being tapped, is formed in the insert 20 and opens out in its second end. These bores 27 and 29 enable a screw 28 to be passed through. When the screw 28 is tightened into the threaded bore 27, the second end of the insert 20 comes into abutment against the end of the housing 29, and the hook 3*a* or 3*b* is held in a fixed position. This position is such that the outside face 30 of the hook is in line with the outside surfaces S of the inside tooling O1, O2, and O3. The surfaces S thus co-operate with the inside surfaces S' of the outside tooling E1 and E2 and with the outside faces 30 of the hooks 3*a* and 3*b* to form the walls of the mold into which the metal powder 5 is to be injected. Thus, the outside faces 30 of the hooks 3*a* and 3*b* are in contact with the powder 5 when it is compressed by HIC.

In order to perform practical HIC, the assembly constituted by the tooling, the hooks, the inserts, the screws, and the powder is put into an autoclave at high pressure and high temperature, for example a pressure of 1000 bars and a temperature 1200° C. The assembly then becomes compressed under the effect of the temperature and the pressure, and the metal powder becomes densified in order to form the jacket 2. Furthermore, the jacket 2 and the hooks 3*a* and 3*b* are selected to be made out of alloys having compositions that are compatible so as to enable them to become welded together by diffusion welding. In conventional manner, diffusion welding is a method that consists in maintaining parts in contact, in this case the jacket 2 and the hooks 3*a* and 3*b*, under given pressure and temperature for a controlled length of time. In this case, the proper temperature and pressure conditions are reached during the HIC cycle. The plastic deformation created at the surfaces of the parts ensures that contact is intimate and also ensures that elements migrate or diffuse between the parts, providing they are made out of alloys that are compatible.

It should be observed that the diffusion welding method requires the outside faces 30 of the hooks 3*a* and 3*b* to be properly prepared.

Advantageously, the inserts 20 that are used made of a third alloy that is identical or analogous to the second alloy in that it is more refractory than the first alloy and it is compatible with the first alloy from the diffusion point of view.

Thus, like the hooks 3*a* and 3*b*, the inserts 20 are bonded to the jacket 2 by diffusion welding during the HIC cycle.

In the example shown, the body 24 and the insert 20 also present a peripheral groove 26. This groove 26 is annular and formed in the zone where the body 24 comes into contact with the metal powder 5. Thus, the powder 5 penetrates into the inside of the groove 26 which is embedded in the mass of the jacket 2 during manufacture. The optional groove 26 thus improves fastening between the insert 20 and the jacket 2.

Once the jacket 2 has been molded, the mold is destroyed, e.g. for a mold made of mild steel by being dissolved in acid, e.g. nitric acid, after which the screws 28 are undone.

Thereafter, the casing is mounted inside an airplane turbojet. The now-free tapped bores 27 can then be used for fastening perforated pipes fitted with corresponding threaded tanks, thus enabling cold air to be blown onto the casing 1 in order to cool it.

What is claimed is:

1. A turbine stator casing comprising a jacket and fastener hooks for fastening a turbine distributor nozzle, the fastener hooks projecting from an inside face of the jacket, wherein said jacket is made of a first alloy by hot isostatic compression, using metal powder, said fastener hooks being made of a second alloy containing nickel and/or cobalt, that is more refractory than the first alloy, and being secured to said jacket by diffusion welding during the hot isostatic compression;

said turbine stator casing further including inserts passing through the fastener hooks and said jacket; and wherein each insert presents a peripheral groove embedded in the mass of said jacket.

2. A turbine stator casing according to claim 1, wherein said inserts are secured to said jacket by diffusion welding during the hot isostatic compression.

3. A turbine stator casing according to claim 1, wherein each insert presents a first end on which a shoulder is formed that comes into abutment against one of the fastener hooks.

4. A turbine stator casing according to claim 1, wherein each insert presents an end that projects from an outside face of the jacket so as to form a projection.

5. A turbine comprising a turbine stator according to claim 1.

6. A turbojet comprising a turbine stator according to claim 1.

7. A turbine stator casing comprising a jacket and fastener hooks for fastening a turbine distributor nozzle, the fastener hooks projecting from an inside face of the jacket, wherein said jacket is made of a first alloy by hot isostatic compression, using metal powder, said fastener hooks being made of a second alloy containing nickel and/or cobalt, that is more refractory than the first alloy, and being secured to said jacket by diffusion welding during the hot isostatic compression;

said turbine stator casing further including inserts passing through the fastener hooks and said jacket;

wherein each insert presents an end that projects from an outside face of the jacket so as to form a projection; and wherein a tapped bore is formed in said insert and opens out through said end.

8. A turbine stator casing according to claim 7, wherein said inserts are secured to said jacket by diffusion welding during the hot isostatic compression.

9. A turbine stator casing according to claim 7, wherein each insert presents a first end on which a shoulder is formed that comes into abutment against one of the fastener hooks.

10. A turbine stator casing according to claim 7, wherein each insert presents an end that projects from an outside face of the jacket so as to form a projection.

11. A turbine comprising a turbine stator according to claim 7.

12. A turbojet comprising a turbine stator according to claim 7.

13. A turbine stator casing comprising a jacket and fastener hooks for fastening a turbine distributor nozzle, the fastener hooks projecting from an inside face of the jacket, and comprising inserts passing through the fastener hooks and said jacket, wherein said jacket is made of a first alloy by hot isostatic compression, using metal powder, wherein said fastener hooks are made of a second alloy that is more refractory than the first, and are secured to said jacket by diffusion welding during the hot isostatic compression, and wherein each insert presents a first end on which a shoulder is formed that comes into abutment against one of the fastener hooks.

14. A turbine stator casing according to claim 13, wherein said inserts are secured to said jacket by diffusion welding during the hot isostatic compression.

15. A turbine stator casing according to claim 14, wherein each insert presents a second end that projects from an outside face of the jacket so as to form a projection.

16. A turbine stator casing according to claim 15, wherein a tapped bore is formed in said insert and opens out through its second end.

17. A turbine stator casing according to claim 14, wherein each insert presents a peripheral groove embedded in the mass of said jacket.

18. A turbine stator casing according to claim 13, wherein said second alloy contains nickel and/or cobalt.

19. A turbine comprising a turbine stator according to claim 13.

20. A turbojet comprising a turbine stator according to claim 13.

21. A method of manufacturing a turbine stator casing comprising a jacket made of a first alloy and fastener hooks for fastening a turbine distributor nozzle, the fastener hooks projecting from an inside face of said jacket, wherein said fastener hooks are made of a second alloy that is more refractory than the first, said method comprising the steps of:

placing the fastener hooks inside a mold;

filling the mold with a metal powder of the first alloy;

disposing the fastener hooks so as to be in contact with said powder;

molding said jacket by hot isostatic compression of said metal powder;

bonding the fastener hooks to the jacket by diffusion welding during the hot isostatic compression; and fastening the fastener hooks to said mold by inserts to guarantee that the fastener hooks are properly positioned during hot isostatic compression.

22. A method of manufacturing a turbine stator casing according to claim 21, wherein said fastener hooks are made as castings.

23. A method of manufacturing a turbine stator casing according to claim 21, further comprising destroying said mold after said molding of said jacket.

24. A method of manufacturing a turbine stator casing according to claim 21, wherein said second alloy contains nickel and/or cobalt.

* * * * *